US006951435B1

(12) United States Patent
Fennessy, Sr.

(10) Patent No.: US 6,951,435 B1
(45) Date of Patent: Oct. 4, 2005

(54) METHOD AND APPARATUS FOR FORMING NEW AND RETROFIT DETECTABLE WARNING SURFACES

(75) Inventor: Paul Michael Fennessy, Sr., Liverpool, NY (US)

(73) Assignee: Global Trade Enterprises, Ltd., Liverpool, NY (US)

( * ) Notice: Subject to any disclaimer, the term of this patent is extended or adjusted under 35 U.S.C. 154(b) by 43 days.

(21) Appl. No.: 10/949,234

(22) Filed: Sep. 27, 2004

Related U.S. Application Data

(63) Continuation of application No. 10/625,852, filed on Jul. 24, 2003, now abandoned.

(60) Provisional application No. 60/421,562, filed on Oct. 28, 2002, provisional application No. 60/400,058, filed on Aug. 2, 2002.

(51) Int. Cl.[7] ..... E04B 1/16

(52) U.S. Cl. ..... 404/75; 249/2; 249/188; 264/32

(58) Field of Search ..... 404/19, 72, 73, 404/75; 249/2, 188, 207; 425/461, 470; 264/31–33

(56) References Cited

U.S. PATENT DOCUMENTS

| | | | |
|---|---|---|---|
| 667,898 | A | 2/1901 | Wilcke |
| 1,096,445 | A | 5/1914 | McKesson |
| 1,807,024 | A | 5/1931 | Anderson |
| 2,410,472 | A | 11/1946 | Wartha |
| 2,517,432 | A | 8/1950 | Hornberger |
| 2,752,732 | A | 7/1956 | Walker |
| 3,463,653 | A | 8/1969 | Letter |
| 3,507,740 | A | 4/1970 | Gaspari |
| 3,579,926 | A | 5/1971 | Gaspari |
| 3,605,575 | A | 9/1971 | Stevanon |
| 3,628,210 | A | 12/1971 | Padgett |
| 3,887,293 | A | 6/1975 | Bowman |
| 3,916,050 | A | 10/1975 | Kurhajec |
| 3,930,740 | A | 1/1976 | Bowman |
| 3,936,209 | A | 2/1976 | Krage |
| 4,131,406 | A | 12/1978 | Fresquez |
| 4,135,840 | A | 1/1979 | Puccini et al. |
| 4,231,677 | A | 11/1980 | Roming |
| D257,825 | S | 1/1981 | Puccini et al. |
| 4,316,766 | A | 2/1982 | Levin et al. |
| D272,037 | S | 1/1984 | Puccini |

(Continued)

FOREIGN PATENT DOCUMENTS

| | | |
|---|---|---|
| GB | 2 111 897 | 7/1983 |

(Continued)

OTHER PUBLICATIONS

28 C.F.R. Ch. 1 (Jul. 1, 1999 Edition), p. 53, "4.29.2 Detectable Warnings" (1 page). Dept. of Justice Pt. 36, App. A.

(Continued)

*Primary Examiner*—Gary S. Hartmann
(74) *Attorney, Agent, or Firm*—Shlesinger, Arkwright & Garvey LLP

(57) ABSTRACT

Method and apparatus suited for forming retrofit detectable warning surfaces on existing surfaces or new warning surfaces. Apparatus includes a tool in the form of a stamp having one or more dome-shaped volumes that may be truncated domes. Dome-shaped volumes may have interior beginning on a bottom side of a stamp and the truncated portion may be defined by a hole provided in a top side of the stamp. Thanks to the hole, when the stamp is removed from the unhardened concrete, the hole functions as a pressure-relief or pressure-equalizing valve eliminating undesirable distortion of the unhardened concrete and ensuring formation of desired dome-shaped concrete projections.

19 Claims, 6 Drawing Sheets

U.S. PATENT DOCUMENTS

| | | | | | |
|---|---|---|---|---|---|
| D279,544 | S | | 7/1985 | Duncan | |
| D282,623 | S | | 2/1986 | Nasvik | |
| 4,620,816 | A | | 11/1986 | Kupfer | |
| 4,646,480 | A | | 3/1987 | Willilams | |
| 4,646,482 | A | | 3/1987 | Chigjian | |
| 4,715,743 | A | | 12/1987 | Schmanski | |
| 4,776,723 | A | | 10/1988 | Brimo | |
| 4,798,364 | A | | 1/1989 | Scott | |
| 4,801,490 | A | | 1/1989 | Schuette | |
| 4,828,426 | A | | 5/1989 | Hendricks et al. | |
| 4,838,728 | A | | 6/1989 | McKeever | |
| 4,954,192 | A | | 9/1990 | Dziekan | |
| 4,993,867 | A | | 2/1991 | Usow | |
| 5,061,172 | A | | 10/1991 | Fennessy, Sr. | |
| 5,124,182 | A | | 6/1992 | Kubo et al. | |
| 5,156,248 | A | * | 10/1992 | Caron | 192/98 |
| 5,219,511 | A | | 6/1993 | Fennessy, Sr. | |
| D338,817 | S | | 8/1993 | Fennessy, Sr. | |
| 5,271,690 | A | | 12/1993 | Fennessy, Sr. | |
| 5,320,790 | A | | 6/1994 | Lowe | |
| 5,647,571 | A | | 7/1997 | Hupp | |
| 5,733,470 | A | | 3/1998 | Roth et al. | |
| 5,800,246 | A | | 9/1998 | Tomioka | |
| 5,827,009 | A | | 10/1998 | Kokoletsos | |
| 5,927,034 | A | * | 7/1999 | Cole | 52/391 |
| 5,958,170 | A | | 9/1999 | Cetrangolo | |
| 5,980,362 | A | | 11/1999 | Hensler | |
| 6,199,545 | B1 | | 3/2001 | Adamson | |
| 6,436,944 | B1 | | 8/2002 | Maytom | |
| 6,444,077 | B1 | | 9/2002 | Fennessy, Sr. | |
| 6,499,910 | B1 | | 12/2002 | Grahmbeek et al. | |
| 6,588,975 | B2 | | 7/2003 | Ross | |
| 6,756,006 | B1 | * | 6/2004 | Levijoki | 264/259 |

FOREIGN PATENT DOCUMENTS

| | | | |
|---|---|---|---|
| GB | 2 176 826 | | 1/1987 |
| GB | 2 208 883 | | 4/1989 |
| GB | 2 214 211 | | 8/1989 |
| JP | 50-22072 | | 7/1995 |
| JP | 50-22073 | * | 7/1995 |

OTHER PUBLICATIONS

Unknown, 3 page document discussing New York Department of Transportation (NYDOT) regulations, Figure X02.5 O Dome Spacing, Fig. X02.5P Dome Alignment (3 pages, pre-Aug. 2002).

* cited by examiner

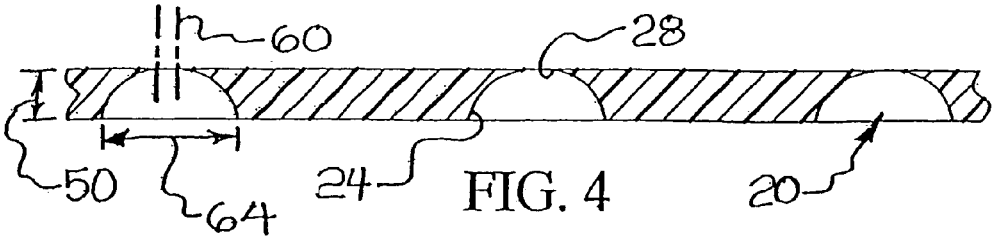
FIG. 4
FIG. 5
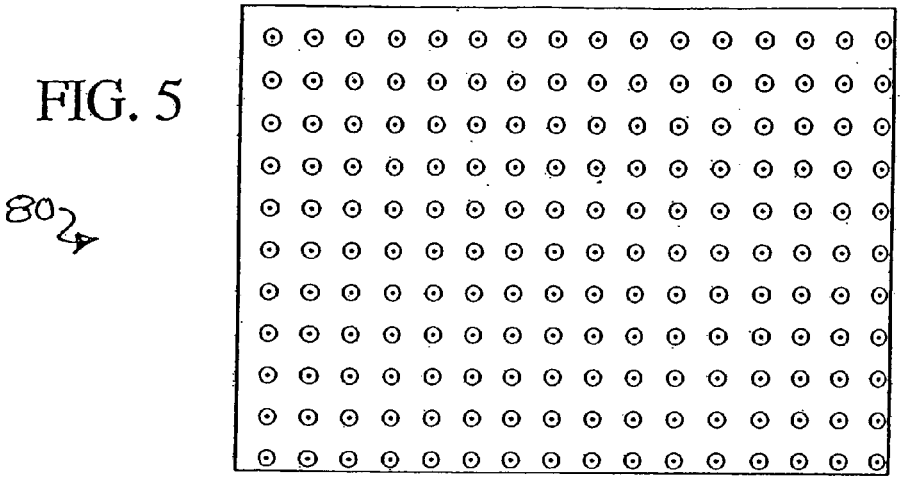
FIG. 6
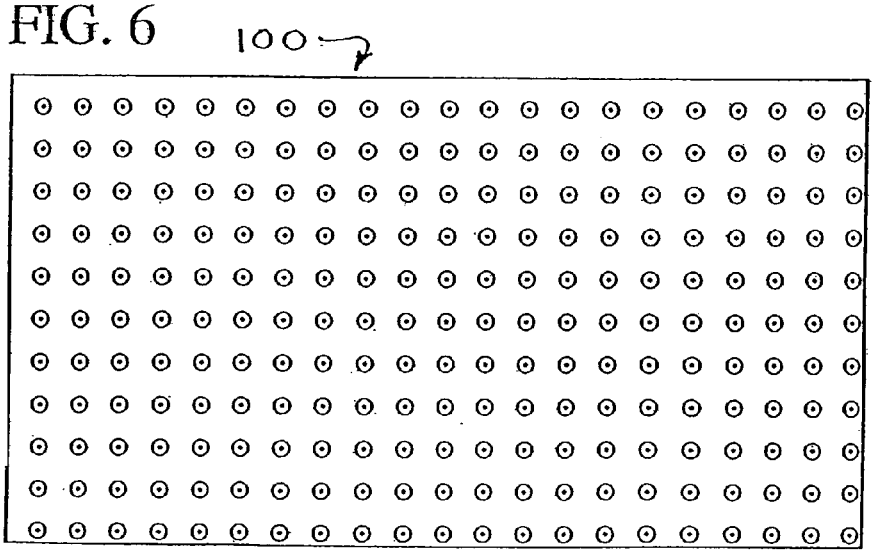
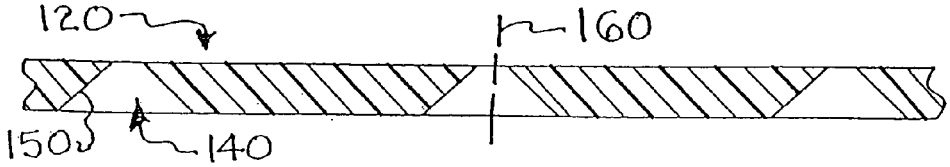
FIG. 7

METHOD AND APPARATUS FOR FORMING NEW AND RETROFIT DETECTABLE WARNING SURFACES

CROSS-REFERENCE TO RELATED APPLICATIONS

This application is a continuation of application Ser. No. 10/625,852, filed Jul. 24, 2003 now abandoned, which claims the convention priority of application No. 60/421,562, filed Oct. 28, 2002, and application claims the convention priority of application No. 60/400,058, filed Aug. 2, 2002, and each of which is incorporated herein by reference.

FIELD OF THE INVENTION

The invention relates to a method and apparatus for forming detectable warning surfaces. More particularly, the invention relates to a method and apparatus for forming such detectable surfaces on walkways, and an apparatus suitable for forming detectable warning surfaces. Even more particularly, the invention relates to a detectable warning surface, tool and method for making such surface, and a method and tool for making a detectable warning surface on an existing surface, such as a walkway; this may be termed a retrofit warning surface.

BACKGROUND OF THE INVENTION

Detectable warning surfaces, such as present on walkways are known.

Federal and state regulations have required such for ten or more years.

Examples include my earlier U.S. Pat. No. 5,271,690 to Fennessy, Sr., U.S. Pat. No. 5,061,172 to Fennessy, Sr., and U.S. Pat. No. Des. 338,817 to Fennessy, Sr.

Each of those earlier patents of mine is incorporated herein by reference.

Additional patents of interest include U.S. Pat. No. 5,219,511 to Fennessy, Sr. and U.S. Pat. No. 6,444,077 to Fennessy.

SUMMARY OF THE INVENTION

The invention includes a method, an apparatus, and apparatus for forming detectable warning surfaces, such as on walkways.

Invention likewise relates to a method and apparatus particularly suited for forming retrofit detectable warning surfaces on existing surfaces, for example. The invention includes an apparatus, such as a tool in the form of a stamp having one or more domes or dome-shaped projections that may be truncated domes.

The truncated domes may be formed by use of a tool according to the invention. Such a tool may include a stamp having one or more truncated domes defined therein. The truncated upper portions of the dome may be formed thanks to the large diameter of the truncated dome beginning on a bottom side of the stamp, and the truncated portion being defined by a hole in the top side of the stamp. By having the hole formed as a through hole, a user may smooth out the unhardened material, such as cement or concrete, and the troweling or smoothing by the user will form the flat top of the truncated dome. Thanks to the hole defining the truncated portion and the remainder of the dome, when the stamp is removed from the unset material, the presence of a hole or holes in the top of the stamp allows air to enter, into the hole as the stamp is being removed. In that manner, the likelihood of a suction force or vacuum being formed is greatly reduced and the stamp may be removed from the unset or unhardened material without a distortion of the truncated dome shape defined by the stamp.

The truncated domes may have the shape of a dome defined by a slice taken through a sphere, a slice taken through a conic, and other forms. The inventive dome may take any shape that meets the purpose of a warning surface, and the shape may be defined by a tool, such as a stamp in which the detectable warning surface shape includes a portion defined by a hole in the top side of the stamp as well as the bottom side of the stamp.

The invention includes detectable warning surfaces in which each of the warning bumps or domes formed on the surface, such as the sidewalk, is arrayed in a gridwork of columns and rows, unlike prior art warning surfaces in which some of the warning bumps were offset from the columns and rows. In this manner, alignment of a stamping tool for defining the warning surface may be readily made.

The stamp may be made of a flexible template, the template being made of urethane, and as will readily be appreciated, the template will have a thickness typically corresponding to the height of the truncated domes to be formed.

Relative terms such as up, down, left, and right are for convenience only and are not intended to be limiting.

BRIEF DESCRIPTION OF THE DRAWINGS

FIG. 4 is a sectional view taken along line 4—4 of FIG. 3;

FIG. 5 is a top plan view of another embodiment of a stamp according to the invention;

FIG. 6 is a top plan view of another further embodiment of a stamp according to the invention;

FIG. 7 is a sectional view of yet another embodiment of stamp according to the invention shown in a manner similar to FIG. 4;

FIG. 12 is a top plan view of a hardened surface according to the invention after the addition of at least one of a colorant, sealant, paint, and the like.

DETAILED DESCRIPTION OF THE INVENTION

The entire disclosure of U.S. Pat. No. 5,271,690 to Fennessy, Sr. is incorporated herein by reference.

The inventive method and apparatus may be understood by reference to Fennessy, Sr. '690.

It has been found that a liquid release agent may be used instead of the powder colored released agent described in column 4, lines 23–44, of Fennessy, Sr. '690.

The liquid release agent may be a liquid release agent such as STAMPCRETE® liquid release agent available from Stampcrete™ International, Liverpool, N.Y. 13088 (Part No. SR-22 Liquid Release Clear).

The use of the liquid release agent ensures that the truncated dome or dome-shaped projections formed by the truncated concavities, described below, are formed evenly.

In general, during the forming process, in order to obtain an even spacing of the rows of detectable warning surfaces, such as the truncated concrete domes formed by the inventive tool, for example, a stamp members, one may use one or more stamp members.

In that manner, while the first stamp member is in place on top of concrete while forming a first series of domes, a second stamp member may be laid next to the first stamp member. Then, the first tool or stamping member may be removed.

In that manner, a better alignment and spacing of the adjacent rows of thus formed concrete truncated domes is achieved. For some users, it may be difficult to obtain an evenly aligned concrete dome distribution by the use of one stamp member alone.

Figure 1:
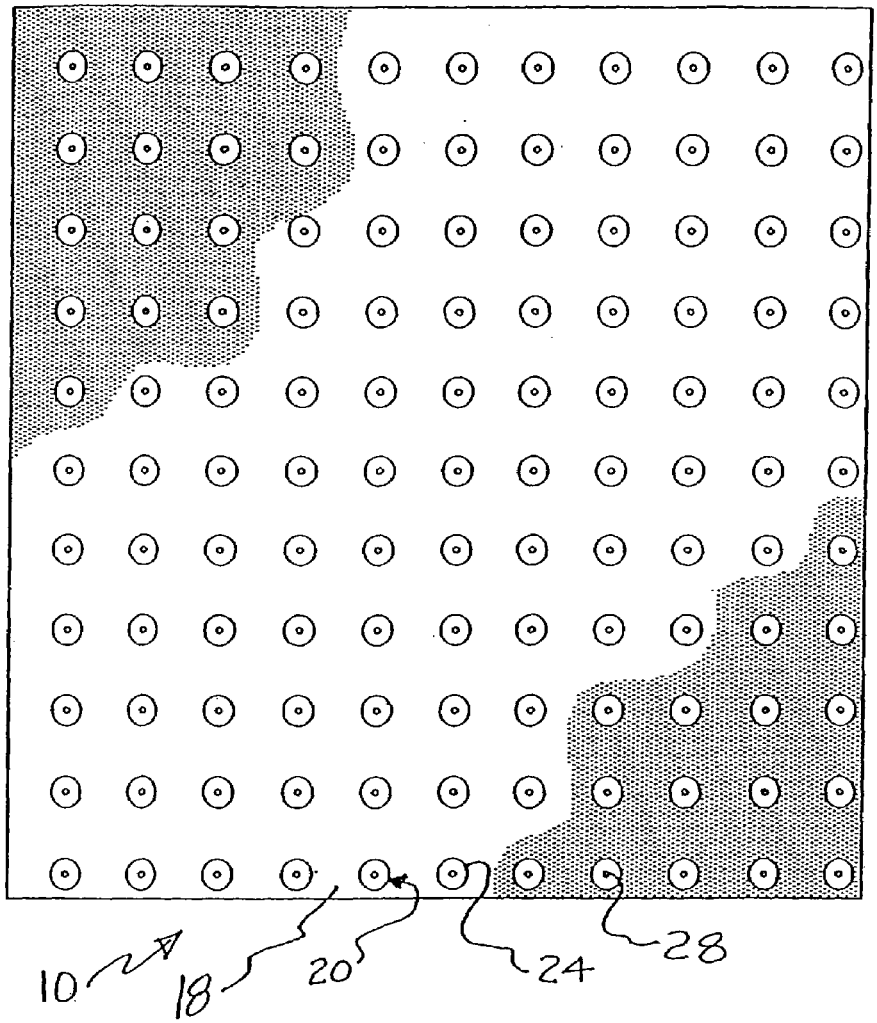
FIG. 1 is top plan view of a stamp according to the invention.

Various embodiments of the stamp member used in accordance with the method of the present invention are shown in FIGS. 1, 5, and 7 of the drawings.

A first embodiment of the inventive apparatus nay be a stamp member 10 as shown in FIGS. 1–4.

Stamp member 10 includes a generally planar front on top surface 18 and a rear or bottom surface 22. Stamp member 10 is comprised of a flexible material. Stamp 10 may be formed from a flexible elastomeric material having memory. The flexible elastomeric material may be urethane or polyurethane.

Figure 8:
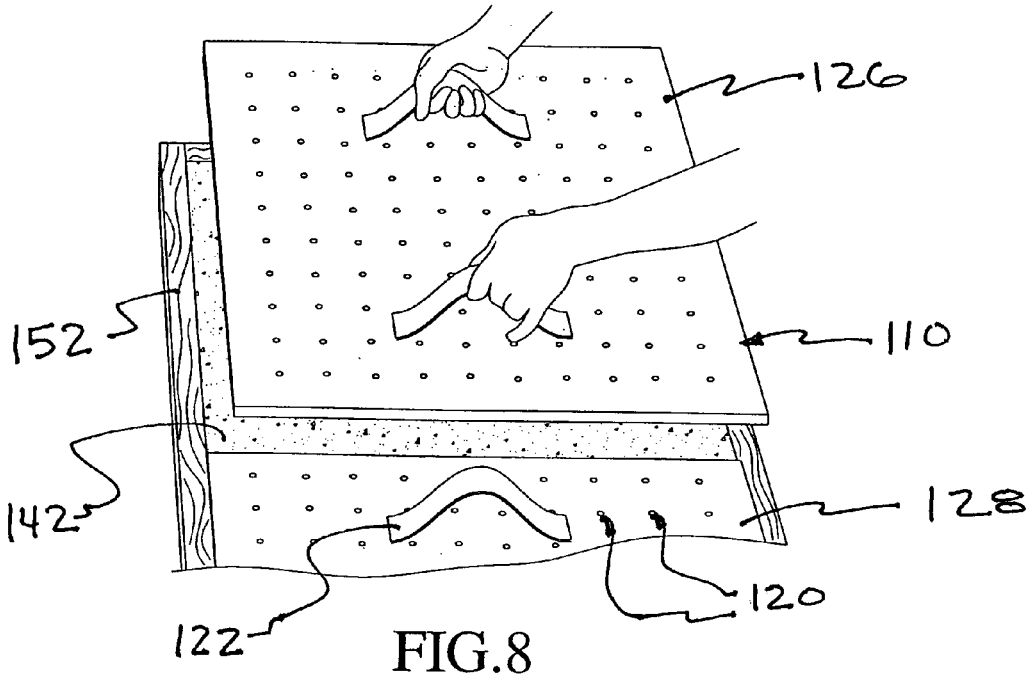
FIG. 8 is a top perspective view of another embodiment of a stamp according to the invention, in use.

A description of optional handles as well as optional layers forming the stamp member may be found in U.S. Pat. No. 5,061,172, which is incorporated herein by reference. Handles are generally unnecessary. However, optional handles may be provided as shown in FIG. 8, described below.

Generally, planar top surface 18 is interrupted by a pattern of indentations in the form of concavities 20. Concavities 20 are arranged in spaced apart rows or columns, the concavities 20 of adjacent rows and/or columns being offset from one another, or the concavities of each of the rows and columns being in columnar alignment with each other.

The stamp member 10 of FIG. 1 may be used to produce a generally planar concrete surface having a pattern of dome-shaped projections or truncated dome-shaped projections substantially the same size and shape as concavities 20.

Figure 3:
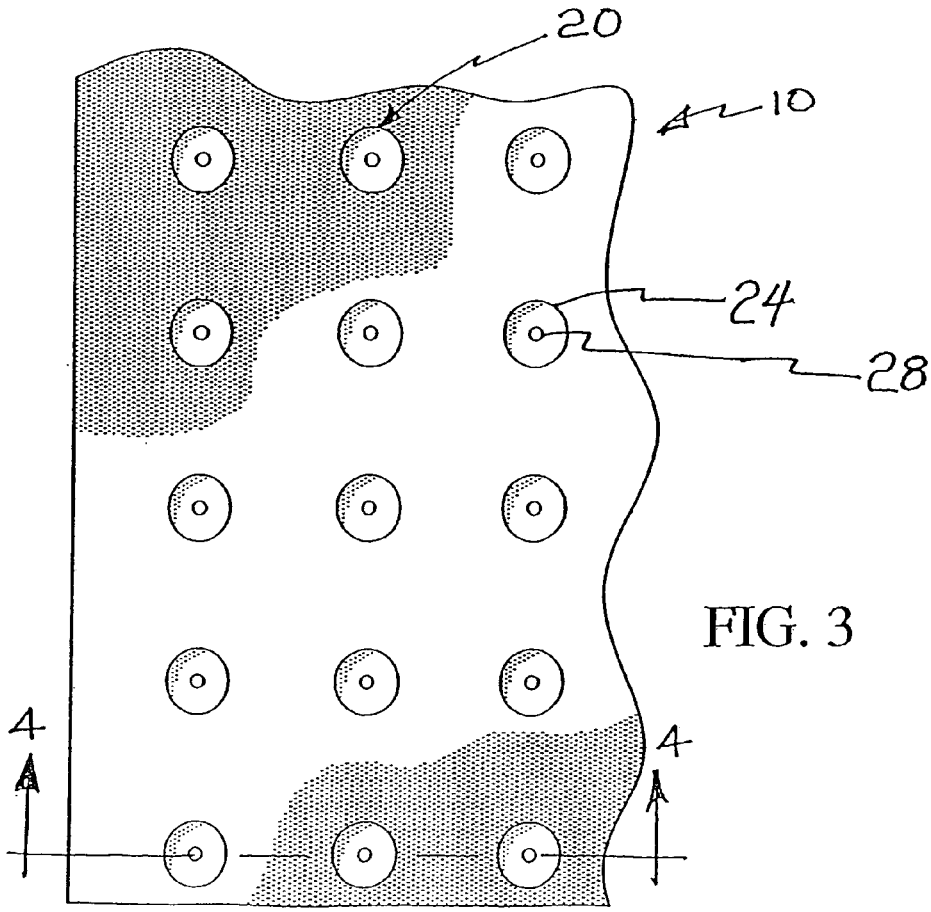
FIG. 3 is an enlarged partial view of the stamp of FIG. 1.

FIG. 3 shows a fragmentary view of the embodiment of stamp 10. The pattern of indentations in the form of truncated concavities 20.

Typically, more than one truncated dome 20 may be provided in stamp 10.

For ease of description, upper surface 18 may be referred to as top surface 18 and a lower surface 22 may be referred to as bottom surface 22. Typically, in use, bottom surface 22 will be pressed against the unhardened or semi-solid substrate to be formed or against an unhardened substrate, such as concrete, placed on a hardened concrete surface. In that manner, a predetermined shape, such as the illustrated truncated concrete dome will be formed by unhardened substrate entering into the dome 20, filling the dome-shaped volume 24, and typically exiting, in part, through a smaller diameter opening 28; i.e, hole 28, defined in top surface 18.

Figure 2:
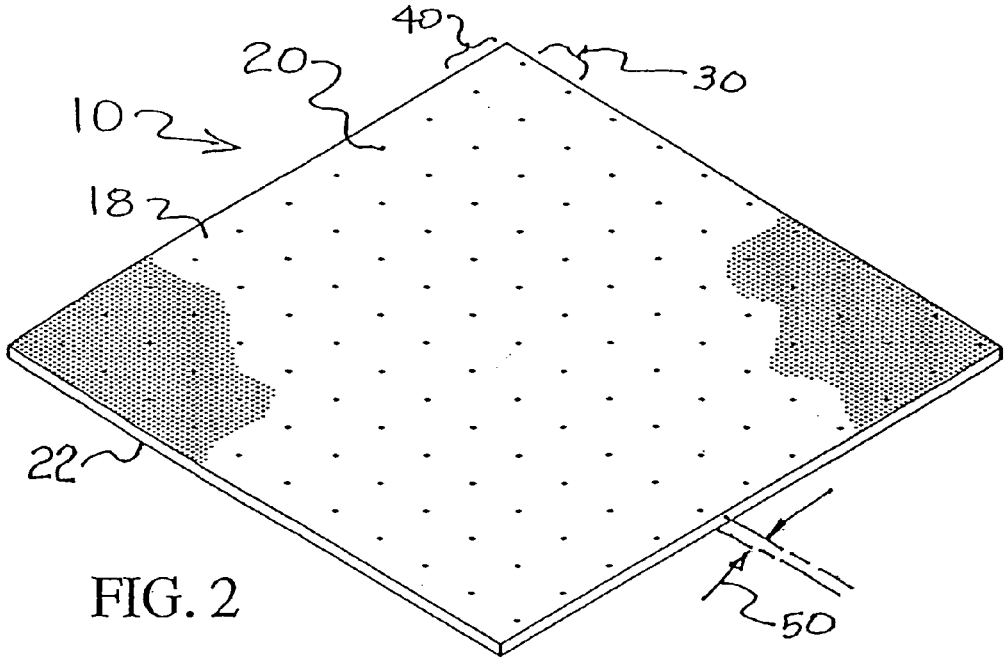
FIG. 2 is a front perspective view of the stamp of FIG. 1.

The dome 20 may have a center-to-center offset 30, as shown in FIG. 2. That center-to-center offset 30 may be termed the offset of columns of dome 20.

The dome 20 may likewise be arrayed in rows having center-to-center offset 40 between adjacent rows.

Figure 13:
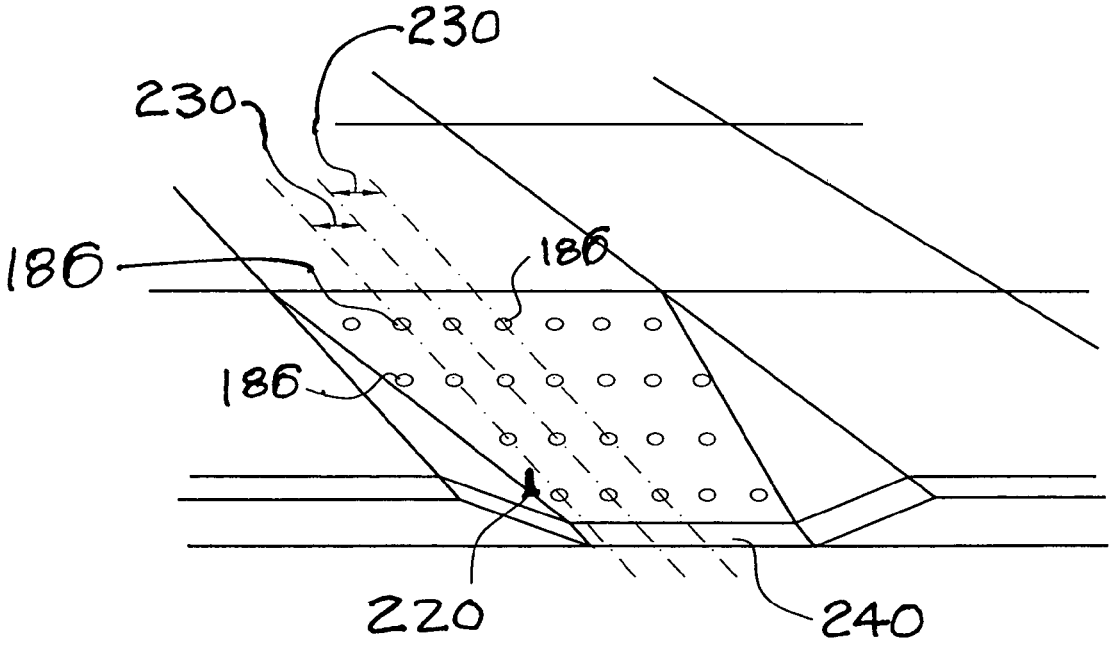
FIG. 13 is a top, schematic perspective view showing a wheelchair ramp for sidewalk cut through having aligned detectable warning bumps according to the invention formed in its surface.

One or both of offsets 30 and 40 may be sufficiently wide so that a wheelchair wheel may pass between the rows of offsets. It is contemplated that offsets of different rows be spaced so that when a wheelchair wheel is accommodated between adjacent rows of hardened substrate formed into truncated domes on warning surfaces by domes 20, the typical other wheel of the wheelchair will likewise be accommodated between another pair of hardened substrate truncated domes. In that manner, the wheelchair user may be substantially unhindered when using a wheelchair ramp, such as illustrated in FIG. 13 described below.

A height or thickness 50 of stamp member 10 will define the height of the truncated dome formed by stamp 10.

Hole 28 may have diameter 60, which diameter 60 may be less than a diameter 64 defining a bottommost portion of dome 20.

Depending on the configuration of hole 28, hole 28 may function as a pressure-relief valve or a pressure-equalizing valve. That is, a pressure-relief valve or element which reduces, though need not completely eliminate, the pressure difference established within the dome-shaped volume 24 and the atmospheric pressure outside of stamp 10, as stamp 10 is being removed from the semi-solid substrate, such as concrete, during the forming of the truncated domes. As long as there is sufficient pressure relief or pressure equalization between the interior of dome-shaped volume 24 and the atmosphere, hole 28 or an equivalent need not fluidly connect the atmosphere outside of stamp 10 and the interior of dome-shaped volume 24. Hole 28 may be a pressure-equalizing valve in that it substantially completely or completely eliminates pressure differences between the interior of volume 24 and the atomsphere.

FIG. 5 illustrates another embodiment of a stamp member 80 according to the invention. Stamp member 80 may be substantially rectangular.

FIG. 6 illustrates another embodiment of a stamp member 100 which is substantially rectangular.

FIG. 7 illustrates a cross-sectional view similar to FIG. 4 of another embodiment of a stamp member 120.

Stamp 120 likewise has dome-shaped holes 140 opening at a top as well as a bottom surface thereof. Truncated volume 150 defined by opening 140 may be in the form of a truncated cone; i.e. a truncated conic section in which the truncated portions are defined by planes extending transversely or perpendicularly relative to a central axis 160 about which truncated conical section or conic 150 has been generated.

Quite simply, in use, an existing substrate such as a sidewalk is sufficiently cleaned to allow adhesion of a new substrate such as concrete thereto.

Then, unhardened concrete is provided on the existing substrate. The stamp member such as stamp 10 is placed on the unhardened concrete with the bottom face 28 being pressed into the unhardened substrate. The stamp member 10 is pressed down sufficiently so that unhardened substrate completely fills the truncated dome 20 and, at least a portion of the unhardened concrete may be forced up through and exit holes 28.

The user then takes a tool, such as a cement trowel, and smooths out and removes the unhardened substrate which has exited hole 28. In that manner, a flat truncated upper portion of the truncated domes being formed is defined. The flat top face 18 serves as a guide and assists in smoothing out the tops of the truncated domes being formed.

The stamp 10 is then removed. The removal of the stamp is easily accomplished without distortion of the thus-formed truncated substrate domes, thanks to the hole 28 allowing in air. Further, a liquid release agent may be provided to assist in the releasing of stamp 10 from the unhardened substrate.

Another description of the method for forming the truncated dome warning surface is described in greater detail below.

The truncated domes 20 may be spaced apart at a a center-to-center offset of, for example, 2.35 inches (60 mm) center-to-center in order to comply with proposed and enacted state and federal regulations.

Each of the columns of truncated domes 20, as well, may be offset at equal distances.

The rows may likewise be offset at equal distances.

In that manner, the resulting molded dome-shaped concrete projections may be arrayed in offset columns and rows, each of which is offset at a distance, such as 2.35 inches.

The offset may be varied to accommodate various wheelchair wheel spacings, for example.

The larger or base diameter 64 of the two diameters of dome 20 may be 0.9 inches (23 mm), the smaller diameter 60 of the two diameters may be 0.45 or 0.5 inches (or about 10 mm), and the height of the dome 20 may be 0.2 inches (5 mm), for example.

It has been found that smaller diameter 60 may be 3-16 inch (4.75 mm) and achieve good release from the unhardened concrete, in use.

The generally dome-shaped concrete warning projections to be produced according to the method of the present invention may have a color visually contrasting with the color of the generally planar surface on which the warning projections are formed, such as on a sidewalk or subway platform.

While a generally square-shaped or rectangular stamp member having a particular pattern of indentations is illustrated in the drawings, it should be understood that stamp members having other shapes and patterns are capable of being used either alone or in combination with each other to produce concrete structures according to the present invention.

The method of using the embodiments of FIGS. 1–7 may be understood from the above-described method, as well as from considering the below-described method of using the embodiment of FIGS. 8–12.

FIG. 8 illustrates another embodiment of a stamp 110 having a number of spaced apart domes 120.

An optional handle 122 may be provided.

In use, a first stamping member 126 is shown being placed adjacent a second stamping member 128 that has already been pressed into an unhardened substrate 142. Stamping member 126 may be placed directly adjacent stamping member 128 to ensure alignment of domes 120. One or more pieces of form work 152 may be provided to enhance the alignment of the domes formed by dome-shaped volumes 120 or for maintaining unhardened substrate 142 in its desired location, as will be readily understood.

Figure 9:
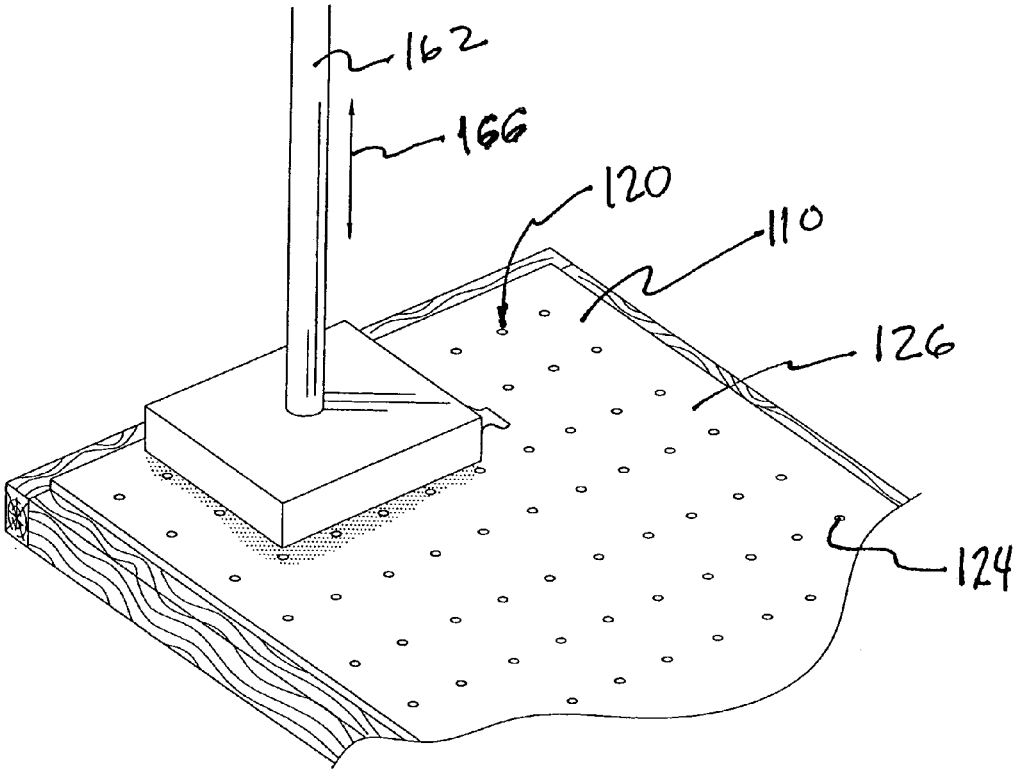
FIG. 9 is a top plan view of the stamp of FIG. 8, in use.

FIG. 9 illustrates a step of tamping down a stamp 110 to ensure that the unhardened substrate being formed by first stamp 126 sufficiently fills each of domes 120. Tamping member 162 may be moved in a direction 166, for example, in order to achieve the desired filling of dome 120. After that step of ensuring the domes 120 are filled, such as by the illustrated tamping with tamper 162, first stamp member 126, for example, may be moved in a direction away from the now-formed substrate 142.

Figure 10:
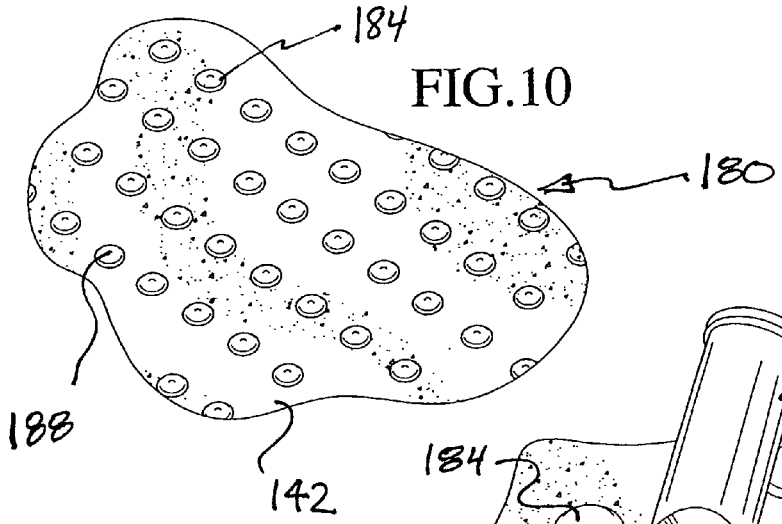
FIG. 10 is a top perspective view of a shaped surface shaped by the inventive tool(s) according to the invention during hardening of the material being shaped.
Figure 11:
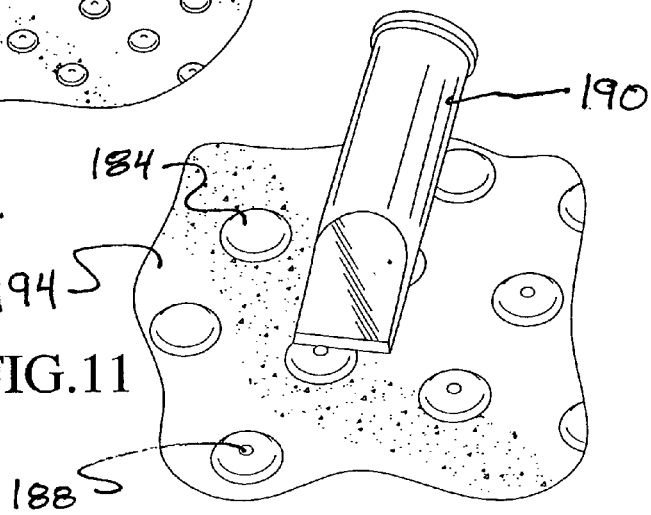
FIG. 11 is a top plan view illustrating the removal of tips formed on top surfaces of the domes according to the invention.

FIG. 10 illustrates the thus formed substrate 180 having a member of formed domes 184, some or all of which domes 184 may include a tip 188 extending away from the remainder of dome 84. Tip 188 will have been formed by unhardened substrate 142 exiting or being forced through the corresponding pressure relief valve or hole 124. Pressure relief hole 124 may be equivalent to hole 28 of the embodiment of FIG. 4, for example.

After at least partial hardening of substrate 142, the user may remove the tips 188, such as with a scraping tool or chisel 190. A floor scraper with a long handle which allows the user to stand while scraping may be used. By removing tips 188, the, typically desired truncated dome configuration is achieved. Still further, tips 188 may have a tendency to break off from the remainder of hardened dome 184, when the hardened substrate is in use as a detectable warning surface. Such breaking off is undesirable as the sealant which may be applied to an upper surface 194 of the hardened substrate would likewise be broken of along with the tip, and the uppermost surface of dome 184 would remain without a sealant on a top portion at the location where the corresponding broken-off tip 188 had been.

Figure 12:
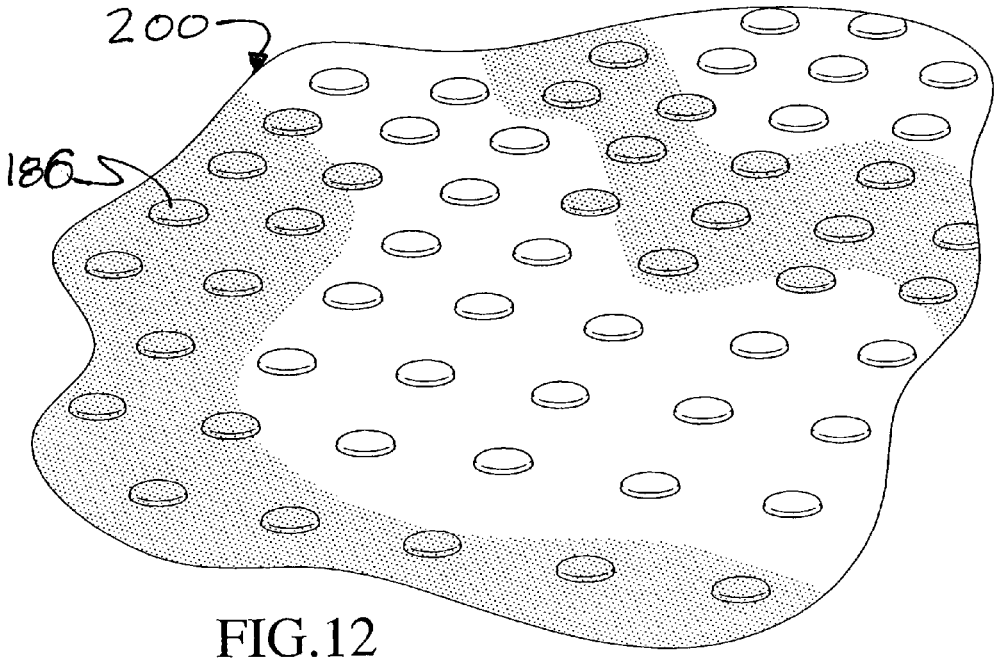

FIGS. 12 and 13 illustrate a finished hardened substrate 200 showing the resultant desired series of aligned finished hardened domes 186 to which a sealant, such as a colored sealant or liquid colorant and sealant has been applied. FIG. 12 shows a typical detectable warning surface formed from hardened substrate 200.

Additional details of a particular embodiment of the invention are set forth below.

It is contemplated that square and rectangular stamping members 80 and 100 may be provided, such as 2'×3' and 2'×4'. Square members may be 2'×2', for example.

Detectable warnings are an Americans with Disabilities Act (ADA) requirement in the current Americans with Disabilities Act Accessibility Guidelines (ADAAG) for the use of detecting the boundary between the sidewalk and the street. Truncated domes, such as domes 184 formed in accordance with the invention, are the only detectable warnings allowed by ADAAG. Grooves, expose aggregate, and other designs intended for use as detectable warning are too similar to pavement textures, cracks and joints and are not considered equivalent facilitation. The detectable warning is a unique and standardized surface intended to function much like a stop sign to alert pedestrians who are blind or visually impaired to the presence of hazards in the line of travel. Truncated domes are a unique design and have proven to be the most detectable surface.

Detectable warnings shall be 24 inches (610 mm) in the direction of travel and extend the full width of the curb ramp or flush surface.

FIG. 13 illustrates a curb ramp 220 including finished, aligned domes 186, spaced apart at an offset 230. A surface 240 may typically extend to a street, for example. Offset 230 may correspond to ADA guidelines.

An exemplary embodiment follows.

Location

The detectable warning shall be located so that the edge nearest the curb line or other potential hazard is 6 to 8 inches (150 to 205 mm) from the curb line or other potential hazard or as specified.

Placement of the detectable warnings a maximum of 6 to 8 inches back from the curb line gives some latitude in placement of the detectable warning. Where curbing is embedded at the sidewalk/street junction, this will not need to be replaced. In addition, allowing 6 to 8 inches of ramp (or curb) surface beyond the detectable warning will give pedestrians who are blind an additional stopping distance before they step into the street. It will also enable some persons having mobility impairments to make a smoother transition between the street and the curb ramp.

Detailed Application/Method

Preparation of Surface: Surface must be structurally sound, clean and free from dust, dirt and other contaminants like mildew. Areas that have had exposure to oil or grease should not have system applied. To clean, use a pressure washer with a light application of bleach and water (3:1 water to bleach) and rinse surface thoroughly. If there are any cracks that need repair, now is the time to do so. If the cracks are not repaired ahead of time, the cracks will come up through your new material as well. All adjoining surfaces should be taped off to protect from contamination.

Priming of Surface: It is important to prime the surface prior to applying material in order to achieve proper adhesion and prevent delamination. The two coats of primer should be applied an hour apart, with the second coat being applied approximately 1 hour before you mix. Apply primer coats with a thin napped roller or brush. A milky look will appear when using a Stampcrete™ primer coat.

Applying Material: Once the milky look has disappeared from the second coat of primer, you are ready to apply your overlay material. Take 1 five-gallon bucket of the red ADA mix and pull out 1-gallon container of Stampcrete™ liquid resin. Take the gallon of resin and pour into a clean, empty 5-gallon bucket. Mix the resin with the liquid colorant of Brick Red, Charcoal or Dark Brown colorant, for example, to the desired amount, but make sure to keep consistent if more than one kit is needed. You will need a mud mixer with a ¾" drill to thoroughly mix the product. Take your 50 pounds of dry-mix and gradually add to the bucket while mixing with drill, Add entire 50 pounds and mix for a minimum of 3–5 minutes, making sure to scrape edges of bucket. Each bucket will yield a coverage of approximately 25 sq. ft (2.3 m^2) at ⅜" (9 mm). Only mix the amount of material needed for each ramp as it will set-up quickly.

Apply material over surface and trowel until achieving a smooth finish of approximately ⅜"–½" thick. Next, apply a generous portion of the liquid release agent to both the surface and your templates. Then place your Stampcrete™ Retrofit ADA tool on the material, using a clear fiberglass trowel to gentle press template into material. You will notice the material coming through the holes in the stamps on which you will be able to use the trowel to knock down and assure that all the truncated domes have proper detail. Gently lift the template from the concrete, and wash stamp immediately to prevent excess material from sticking.

Washing and Sealing of Surface: The following day, hose down the surface to wash any debris, loose material and in particular, the residue from the liquid release agent off the surface. When completely dry, re-tape a border and put plastic around detectable warning area in order to prevent colored sealer from penetrating undesired areas and apply two coats of Color-Seal pigmented sealer to surface. The U.S. Access Board is requiring a contrast of light on dark or dark on light for the area on which one has placed the retrofit system from the adjacent sidewalk. The use of two coats of either the Stampcrete™ Brick Red, Dark Brown or Charcoal matching Color-Seal in addition to the pigmented material to achieve this contrast, as well as protect the surface from harmful elements, is suggested.

| Suggested Colors for use with Stampcrete ™ Mirage and Color-Seal Systems: | | |
|---|---|---|
| Dark Brown | Brick Red | Charcoal |

Typical Suggested Limitations:

DO NOT apply when air temperature is above 90° F. or below 40° F.

DO NOT apply to surface if existing concrete is not fully cured with a minimum of 28 days.

DO NOT apply over grease or oil stained surface.

| Tools and product one may conveniently have on hand: | | | |
|---|---|---|---|
| Mixing paddle & Drill | Rags | Duct Tape | 3" Brush |
| Roller and Roller Frame | 3 Spray Bottles | Clean Pail | Pool Trowel |
| Stamping Tools | ADA Kit | Liquid Colorant | Ruler |
| Liquid Release Agent | Pressure Water | Scrub Brush-Bleach | |
| Color-Seal (Matching Color of Dark Brown, Brick, Red or Charcoal) | | | |

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention or limits of the claims appended hereto.

What is claimed is:

1. A method of forming a detectable warning surface, comprising:

a) providing an unhardened, hardenable, semi-solid material on a surface;

b) providing a tool for forming a surface, the tool including:

i) a stamp;

ii) a forming element provided on the stamp, the forming element including an interior and an exterior, the interior including a forming surface configured for forming a semi-solid material into a predetermined shape; and iii) a pressure-relief element provided adjacent the forming element, the pressure-relief element being sized and configured for causing air to enter and exit the interior of the forming element, in use, so that the predetermined shape is obtained when the stamp is used and the forming element is forming a semi-solid material into the predetermined shape;

c) the pressure-relief element including a hole provided in the stamp, the hole extending between the interior and the exterior;

d) the predetermined shape including a truncated conical section;

e) pressing the forming tool sufficiently into the unhardened semi-solid material so that the forming element forms the semi-solid material into the predetermined shape; and f) pressing the forming tool sufficiently into the unhardened semi-solid material so that excess unhardened semi-solid material extends through the hole of the pressure-relief element.

2. A method as in claim 1, wherein:

a) the predetermined shape includes a series of truncated domes arranged in aligned columns spaced apart at a width wider than a width of a conventional wheelchair tire.

3. A method as in claim 1, wherein:

a) the forming element includes a truncated dome.

4. A method as in claim 1, wherein:

a) the forming element includes a truncated cone.

5. A method as in claim 4, wherein:

a) the forming element includes a series of truncated cones arranged in aligned columns.

6. A method as in claim 1, further including the steps of:

a) determining if any excess material extends beyond the predetermined shape; and b) removing any excess material extending beyond the predetermined shape.

7. A method as in claim 6, further including the step of:

a) allowing the semi-solid material to harden.

8. A method as in claim 1, further including the steps of:

a) allowing the semi-solid material to at least partially harden;

b) determining if any excess partially hardened material has been formed into a tip extending beyond the predetermined shape; and c) removing the tip, if any.

9. A method as in claim 8, wherein:

a) the tip is removed with chisel.

10. A method as in claim 8, wherein:

a) the tip is removed with scraping tool.

11. A method as in claim 6, wherein:

a) any excess material extending beyond the predetermined shape is removed before the any excess material hardens.

12. A method as in claim 11, wherein:

a) the any excess material is removed by troweling.

13. A method as in claim 11, wherein:

a) the any excess material is removed by smoothing.

14. A method as in claim 1, further comprising the steps of:

a) removing the any excess material extending beyond the predetermined shape before the any excess material hardens.

15. A method as in claim 14, wherein:

a) the any excess material is removed by troweling.

16. A method as in claim 14, wherein:

a) the any excess material is removed by smoothing.

17. A method as in claim 1, further comprising the steps of:

a) removing the excess material extending through the hole by troweling, so that a substantially flat truncated upper portion of the truncated conical section is formed.

18. A method of forming a detectable warning surface, comprising:

a) providing an unhardened, hardenable, semi-solid material on a surface;

b) providing a tool for forming a surface, the tool including:

i) a stamp;

ii) a forming element provided on the stamp, the forming element including an interior and an exterior, the interior including a forming surface configured for forming a semi-solid material into a predetermined shape; and iii) a pressure-relief element provided adjacent the forming element, the pressure-relief element being sized and configured for causing air to enter and exit the interior of the forming element, in use, so that the predetermined shape is obtained when the stamp is used and the forming element is forming a semi-solid material into the predetermined shape;

c) the pressure-relief element including a hole provided in the stamp, the hole extending between the interior and the exterior;

d) the predetermined shape including a truncated conical section, and the truncated conical section including a truncated dome;

e) pressing the forming tool sufficiently into the unhardened semi-solid material so that the forming element forms the semi-solid material into the predetermined shape;

f) pressing the forming tool sufficiently into the unhardened semi-solid material so that excess unhardened semi-solid material extends through the hole of the pressure-relief element; and g) removing the excess material extending through the hole by troweling, so that a substantially flat truncated upper portion of the truncated conical section is formed.

19. A method of forming a detectable warning surface, comprising:

a) providing an unhardened, hardenable, semi-solid material on a surface;

b) providing a tool for forming a surface, the tool including:

i) a stamp;

ii) a forming element provided on the stamp, the forming element including an interior and an exterior, the interior including a forming surface configured for forming a semi-solid material into a predetermined shape; and iii) a pressure-relief element provided adjacent the forming element, the pressure-relief element being sized and configured for causing air to enter and exit the interior of the forming element, in use, so that the predetermined shape is obtained when the stamp is used and the forming element is forming a semi-solid material into the predetermined shape;

c) the pressure-relief element including a hole provided in the stamp, the hole extending between the interior and the exterior;

d) the predetermined shape including a truncated conical section, the truncated conical section including a truncated dome;

e) pressing the forming tool sufficiently into the unhardened semi-solid material so that the forming element forms the semi-solid material into the predetermined shape;

f) pressing the forming tool sufficiently into the unhardened semi-solid material so that excess unhardened semi-solid material extends through the hole of the pressure-relief element;

g) allowing the semi-solid material to at least partially harden;

h) determining if any excess partially hardened material has been formed into a tip extending beyond the predetermined shape;

i) removing the tip, if any; and j) the tip being removed with scraping tool.

* * * * *